US008770495B2

(12) United States Patent
Chen

(10) Patent No.: US 8,770,495 B2
(45) Date of Patent: Jul. 8, 2014

(54) SHOWER HEADS

(75) Inventor: Kun-Chih Chen, Changhua (TW)

(73) Assignee: Sunrise Shower Products Co. Ltd., Changhua (TW)

( * ) Notice: Subject to any disclaimer, the term of this patent is extended or adjusted under 35 U.S.C. 154(b) by 181 days.

(21) Appl. No.: 13/619,410

(22) Filed: Sep. 14, 2012

(65) Prior Publication Data

US 2014/0077005 A1 Mar. 20, 2014

(51) Int. Cl.
*B05B 1/18* (2006.01)
*B05B 1/32* (2006.01)

(52) U.S. Cl.
USPC ..... 239/460; 239/456; 239/548; 239/562; 239/587.4

(58) Field of Classification Search
USPC ..... 239/451, 456, 460, 537, 541, 548, 552, 239/553.5, 562, 587.3, 587.4, 590, 590.5
See application file for complete search history.

(56) References Cited

U.S. PATENT DOCUMENTS

| | | | | | |
|---|---|---|---|---|---|
| 1,830,694 | A | * | 11/1931 | Fraser | 239/460 |
| 2,448,792 | A | * | 9/1948 | Fraser | 239/460 |
| 2,657,955 | A | * | 11/1953 | Manning | 239/458 |
| 2,968,443 | A | * | 1/1961 | Manning | 239/460 |
| 3,013,729 | A | * | 12/1961 | McLean | 239/109 |
| 3,065,917 | A | * | 11/1962 | Fraser | 239/460 |
| 3,373,942 | A | * | 3/1968 | Roman et al. | 239/460 |
| 5,918,811 | A | * | 7/1999 | Denham et al. | 239/123 |
| 6,378,790 | B1 | * | 4/2002 | Paterson et al. | 239/456 |
| 2012/0181356 | A1 | * | 7/2012 | Miller et al. | 239/548 |

* cited by examiner

*Primary Examiner* — Darren W Gorman
(74) *Attorney, Agent, or Firm* — Che-Yang Chen; Law Office of Michael Chen

(57) ABSTRACT

A shower head includes a shell, a positioning base, a plurality of water spraying heads, a plastic piece, a metal cover and a handle set. The positioning base has a flat board and a hanging base having an elongated hole at center thereof, and a plurality of hanging slots are circularly disposed at the periphery of the flat board. The water spraying head engages with several hanging slots so as to evenly circularly dispose at the flat board. The plastic piece is formed by injection molding and a through hole is formed at center thereof. The metal cover is made by copper, surface of which has a plurality of cover through holes. The handle set has a control unit, and a connecting rod eccentrically protrudes out from one end of the control unit, and the other end is provided for a nut to lock and engage with a movable handle.

4 Claims, 7 Drawing Sheets

SHOWER HEADS

FIELD OF THE INVENTION

The present invention relates to a shower head, and more particularly to a shower head that produces smooth and even water flow.

BACKGROUND OF THE INVENTION

A conventional shower head is shown in FIG. 6. The conventional shower head (70) includes a covering shell (71), a position base (72), a plurality of spraying heads (73), a metal cover (74) and a control handle set (75), wherein a connecting unit (711) (namely universal connector) is located at an upper portion of the covering shell (71) to connect to a water source. A lower portion thereof has an opening (712) that is used to receive the position base (72) and spraying heads (73) and sealed with the metal cover (74). An installation hole (713) connecting to an inner space of the opening (712) is disposed at one side of the periphery thereof. The position base (72) has a flat board (721), and a tube (722) extends upwards from center of the flat board (721), and a hanging base (723) has an elongated hole (724) at center thereof. A plurality of C-shaped hanging slots (725) are circularly disposed at the periphery of the flat board (721). The spraying head (73) engages with a plurality of hanging slots (725) through a recessed groove (731) at an upper section of the outer periphery, so as to evenly circularly dispose at the flat board (721) of the position base (72). The lower portion thereof is enlarged to form a water outlet portion (732) that forms a plurality of olive-shaped water channel (733) along the surface of the water outlet portion (732). The metal cover (74) is made by copper, surface of which has a plurality of cover through holes (741) made by the mechanical process of drilling or the like. A recessed receiving space is formed at a top surface of the metal cover (74), and a guiding rod (742) protrudes upward from center of the receiving space. The handle set (75) has a control unit (751), and a connecting rod (752) eccentrically protrudes out from one end of the control unit (751), and the other end is provided for a nut (753) to lock and engage with a movable handle (754).

When it is assembled, the spraying head (73) is installed (one by one) at the flat board (721) of the position base (72), and disposed into the covering shell (71) with the position base (72) through the opening (712). When the metal cover (74) covers the opening (712), the guiding rod (742) is inserted into the tube (722), and the through openings (741) are provided for the spraying head (73) to protrude, the position base (72) and the spraying head (73) can be restricted and engaged. Also, the handle set (75) can be fastened through the nut (753) and installed on the installation hole (713). After the installation, the connecting rod (752) of the handle set (75) will be plugged into the elongated hole (724) of the position base (72), so that the movable handle (754) is operated to drive the connecting rod (752) to eccentrically rotate. Thus, the position base (72) can drive the spraying heads (73) to simultaneously move up and down, and the amount and style of the water flows from the water channel (733) can be controlled according to each person's preference by changing relative positions between the water outlet portion (732) and the through openings (741).

However, conventional shower heads may still have the following problems: (i) the precision of the through openings (741) made by mechanical processing and electroplating is difficult to control. If an error occurs during the manufacturing process, the spraying heads (73) and the through openings (741) cannot be maintain at the identical central position (see FIGS. 7 and 8) when the through openings (741) of the metal cover (74) match with the spraying heads (73). This problem would adversely affects the smoothness and uniformity of the water flow; and (ii) the entire metal cover (74) is made by copper and the manufacturing costs may remain high, and the product may not be competitive in the market. Therefore, there remains a need for a new and improved shower head that can overcome the problems mentioned above.

SUMMARY OF THE INVENTION

The problems to solve in the present invention are: (i) the precision of the through openings of the shower head is hard to control, and (ii) the cost of the metal cover remains high.

To solve the problem presented above, the present invention provides a shower head including a shell, a positioning base, a plurality of water spraying heads, a plastic piece, a metal cover and a handle set. A connecting unit is located at an upper portion of the shell to connect to a water source. A lower portion thereof has an opening that is used to receive the positioning base, spraying heads and plastic piece and sealed with the metal cover. An installation hole connecting to an inner space of the opening is disposed at one side of the periphery thereof. The positioning base has a flat board, and a tube extends upwards from center of the flat board, and a hanging base that has an elongated hole at center thereof is sealedly disposed at a top portion of the tube. A plurality of C-shaped hanging slots are circularly disposed at the periphery of the flat board. The water spraying head engages with a plurality of hanging slots through a recessed groove at an upper section of the outer periphery, so as to evenly circularly dispose at the flat board of the positioning base. The lower portion thereof is enlarged to form a water outlet portion that forms a plurality of olive-shaped water channel along the surface of the water outlet portion. The plastic piece is formed by injection molding and a through hole is formed at center thereof. A plurality of through openings are circularly formed at the periphery of the through hole, and the periphery of each through opening forms a protruding edge downward. The metal cover is made by copper, surface of which has a plurality of cover through holes made by the mechanical process of drilling or the like. A recessed receiving space is formed at a top surface of the metal cover, and a guiding rod protrudes upward from center of the receiving space. The handle set has a control unit, and a connecting rod eccentrically protrudes out from one end of the control unit, and the other end is provided for a nut to lock and engage with a movable handle.

Comparing with the conventional arts, the present invention is advantageous because (i) the quality of injection molding is consistent, the precision of which is not easily affected by external environmental factors. Even though some manufacturing errors in mechanical processing or electroplating may occur during drilling the cover through holes of the metal cover, the errors can be corrected by the plastic piece, so that the water spraying head and through opening of the plastic piece can remain at the identical central position, and the water flow can be more even and smoother; and (ii) the receiving space of the metal cover can effectively reduce the amount of copper, and the plastic piece can fill the receiving space for normal usage. So, the structural design can effectively reduce the costs and the shower head is more competitive in the market.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

Figure 1:
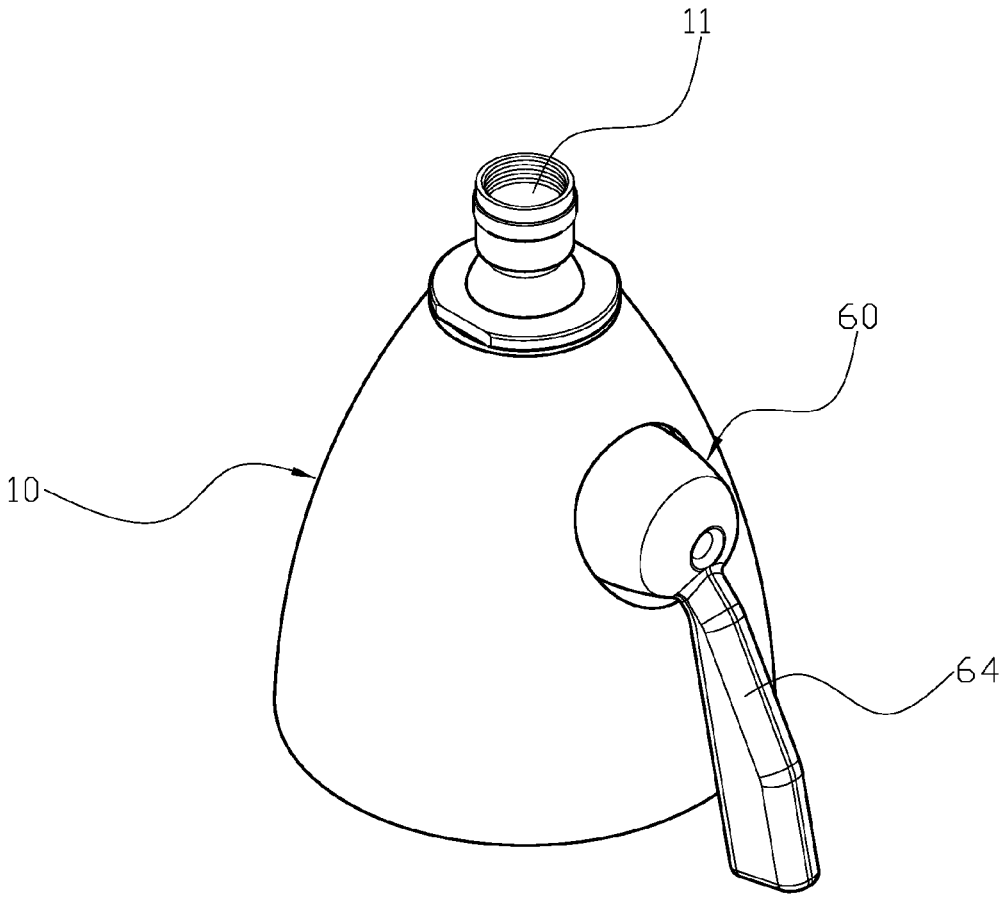
FIG. 1 illustrates a three-dimensional assembled view in the present invention.
Figures 2, 3:
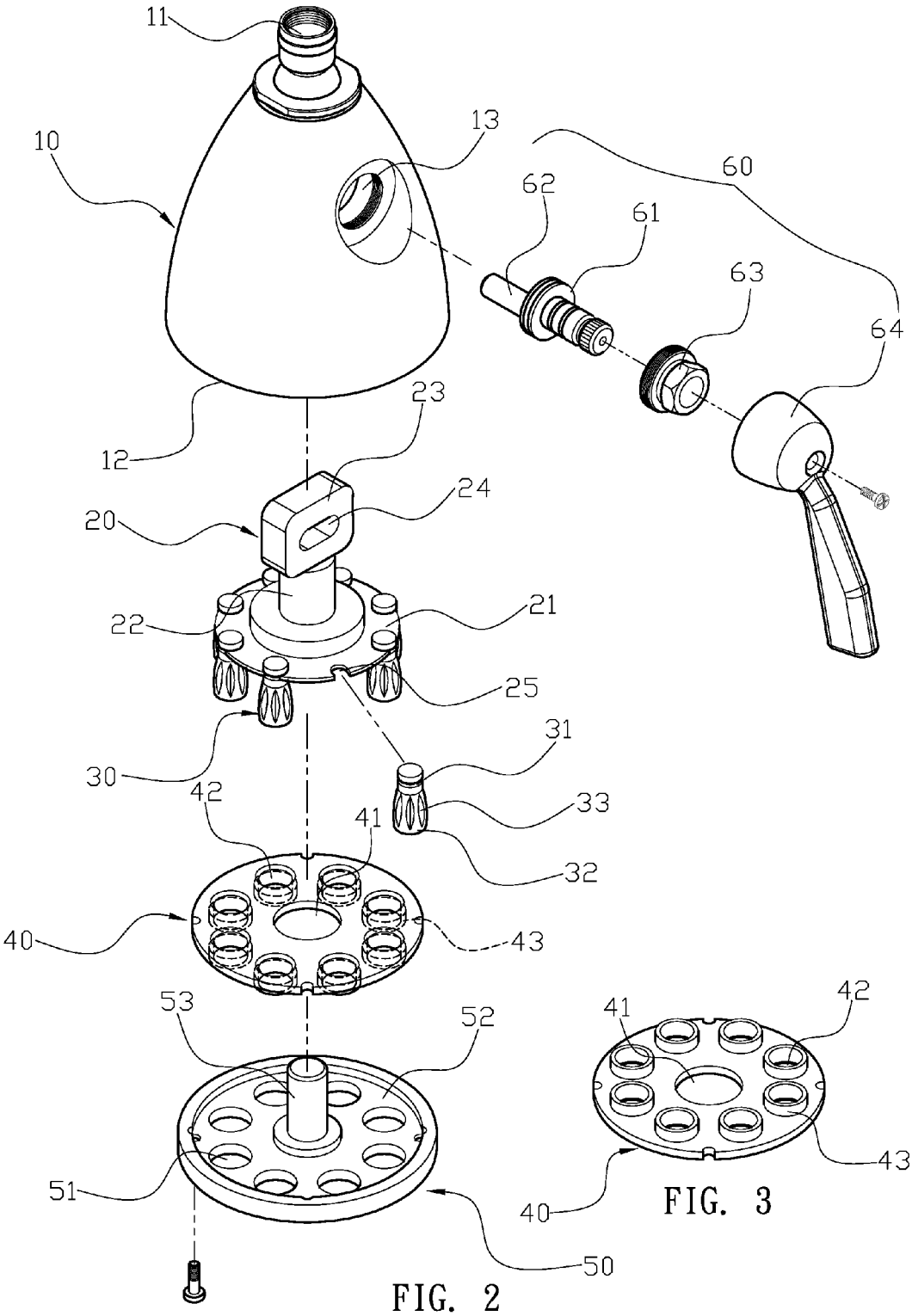
FIG. 2 illustrates a three-dimensional exploded view in the present invention.
FIG. 3 illustrates a three-dimensional view of the plastic piece from another view angle.

In order to further understand the goal, characteristics and effect of the present invention, a number of embodiments along with the drawings are illustrated as following:

Referring to FIGS. 1 and 3, the present invention provides a shower head including a shell (10), a positioning base (20), a plurality of water spraying heads (30), a plastic piece (40), a metal cover (50) and a handle set (60). A connecting unit (11) (namely universal connector) is located at an upper portion of the shell (10) to connect to a water source. A lower portion thereof has an opening (12) that is used to receive the positioning base (20), spraying heads (30) and plastic piece (40) and sealed with the metal cover (50). An installation hole (13) connecting to an inner space of the opening (12) is disposed at one side of the periphery thereof. The positioning base (20) has a flat board (21), and a tube (22) extends upwards from center of the flat board (21), and a hanging base (23) that has an elongated hole (24) at center thereof is sealedly disposed at a top portion of the tube (22). A plurality of C-shaped hanging slots (25) are circularly disposed at the periphery of the flat board (21). The water spraying head (30) engages with a plurality of hanging slots (25) through a recessed groove (31) at an upper section of the outer periphery, so as to evenly circularly dispose at the flat board (21) of the positioning base (20). The lower portion thereof is enlarged to form a water outlet portion (32) that forms a plurality of olive-shaped water channel (33) along the surface of the water outlet portion (32). The plastic piece (40) is formed by injection molding and a through hole (41) is formed at center thereof. A plurality of through openings (42) are circularly formed at the periphery of the through hole (41), and the periphery of each through opening (42) forms a protruding edge (43) downward. The metal cover (50) is made by copper, surface of which has a plurality of cover through holes (51) made by the mechanical process of drilling or the like. A recessed receiving space (52) is formed at a top surface of the metal cover (50), and a guiding rod (53) protrudes upward from center of the receiving space (52). The handle set (60) has a control unit (61), and a connecting rod (62) eccentrically protrudes out from one end of the control unit (61), and the other end is provided for a nut (63) to lock and engage with a movable handle (64).

Figure 4:
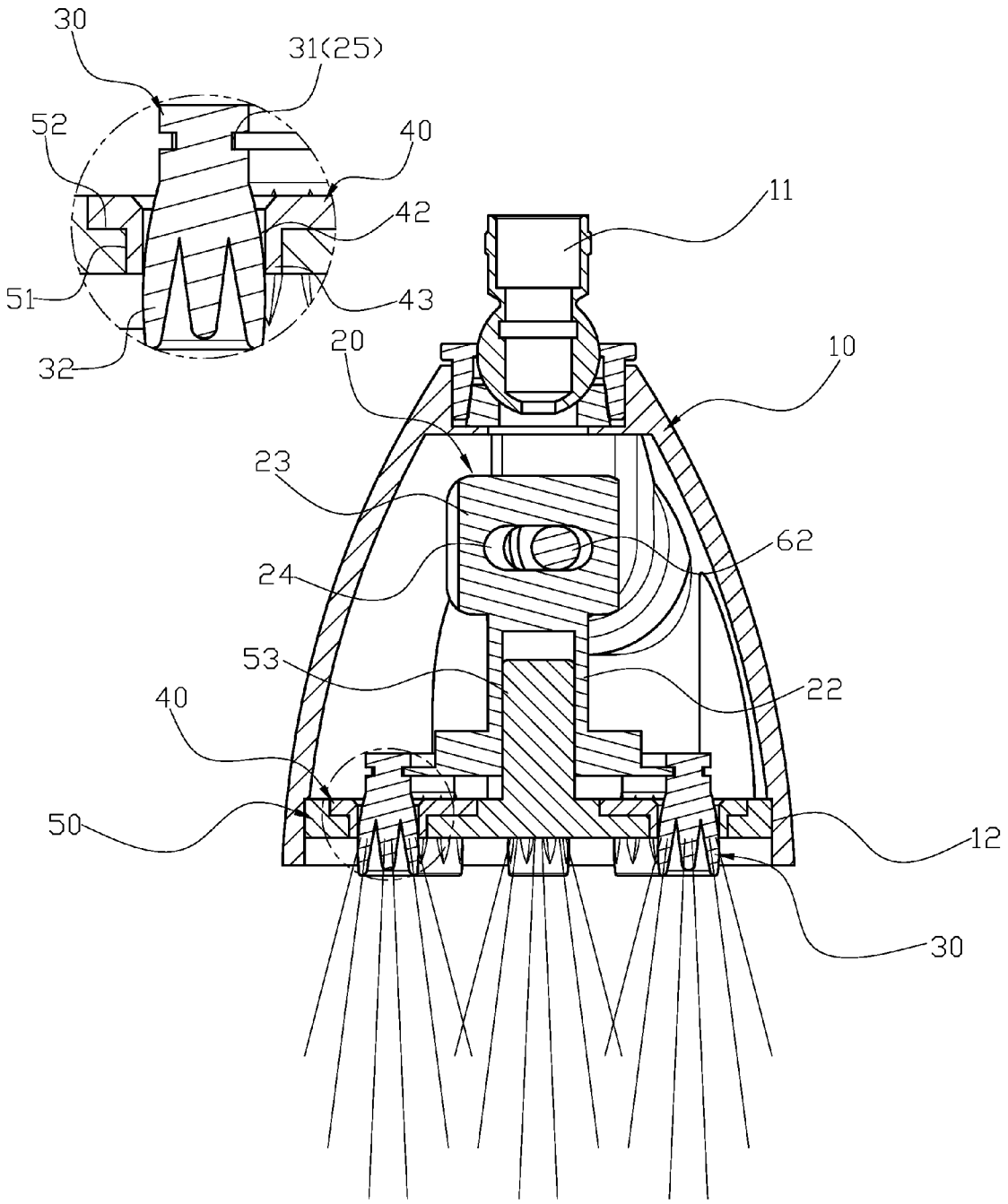
FIG. 4 is a sectional and partial enlarged view of the water output situation in the present invention.
Figure 5:
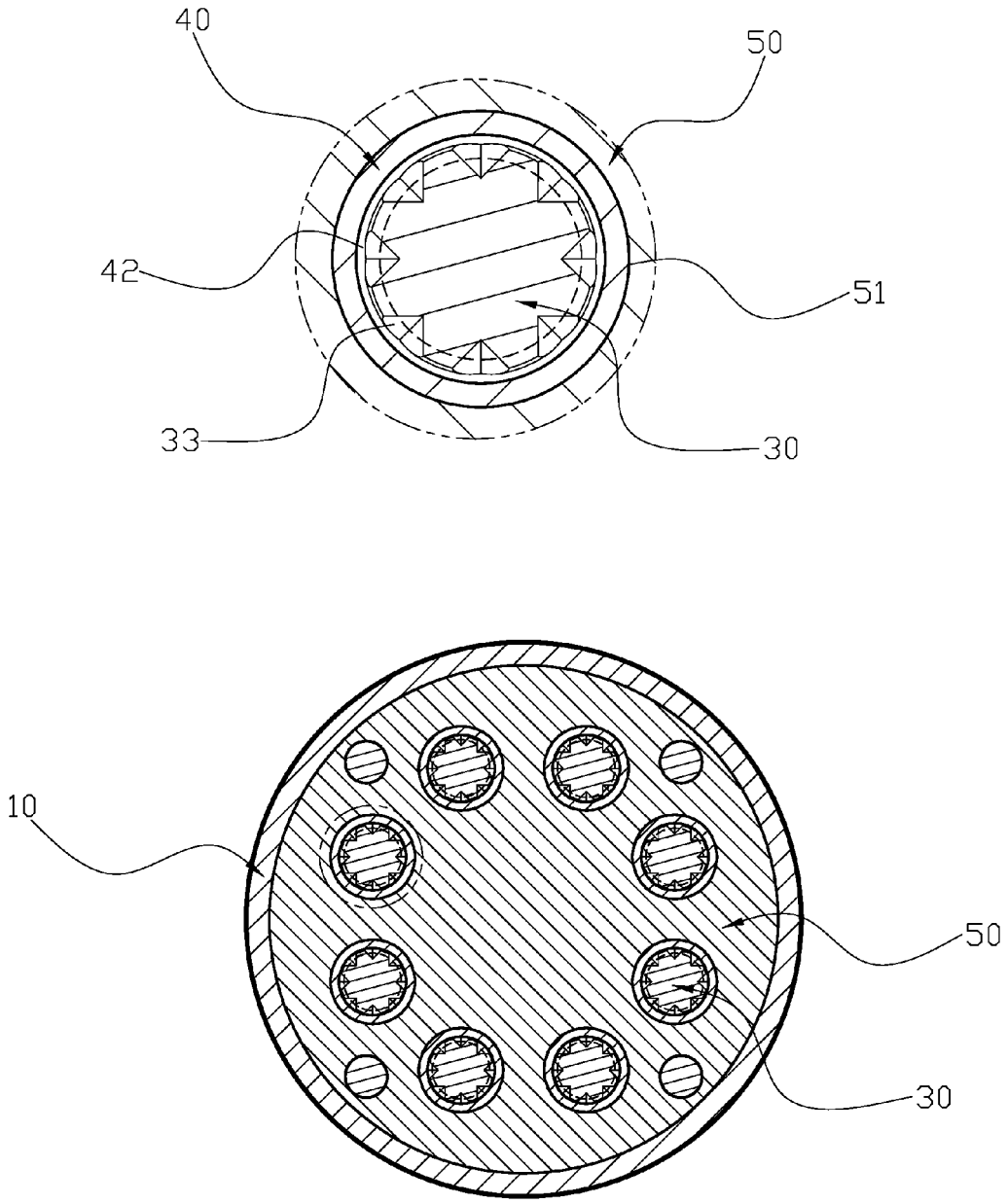
FIG. 5 is a sectional and partial enlarged view of the present invention from another view angle.
Figure 6:
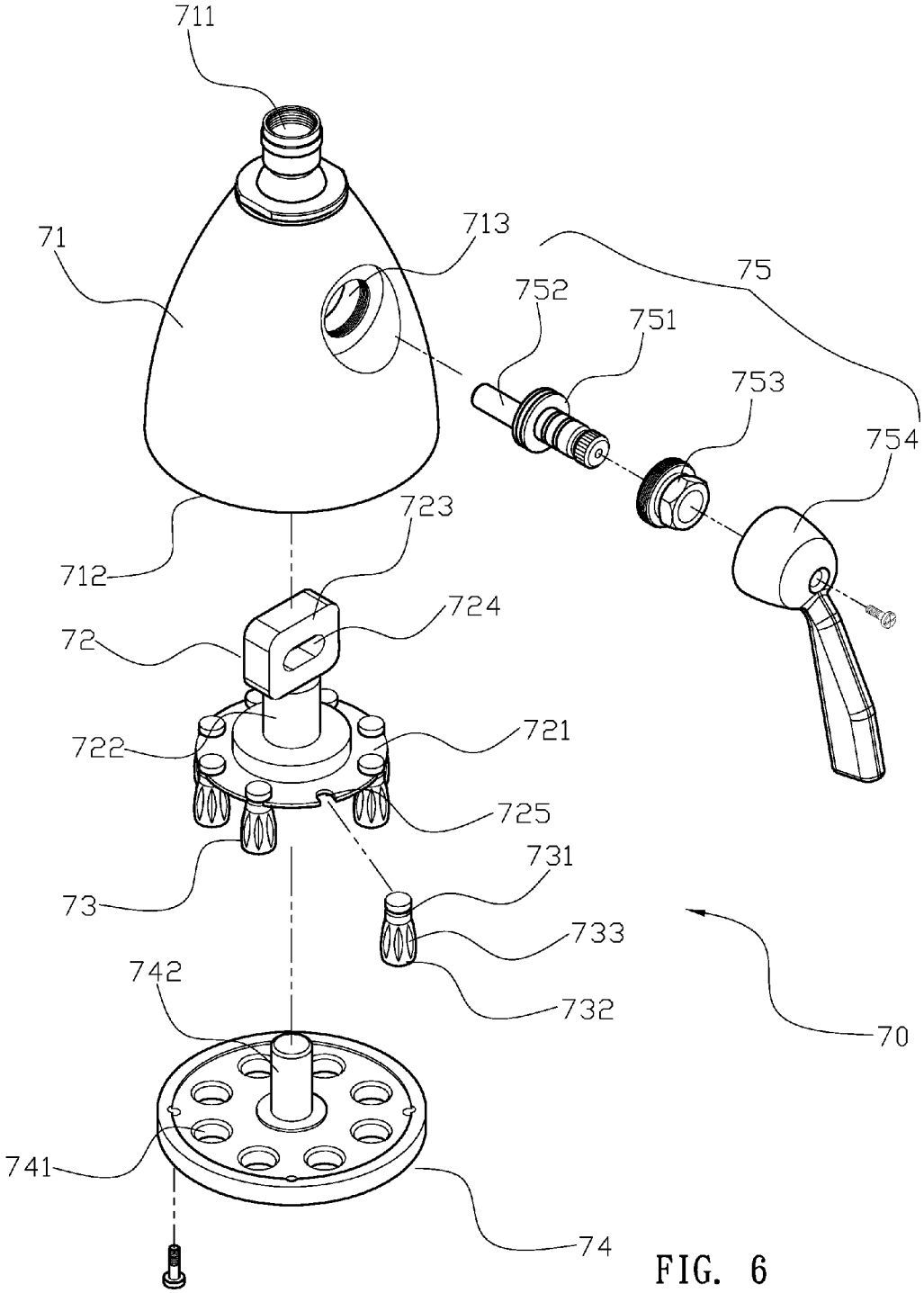
FIG. 6 PRIOR ART
FIG. 6 is a three-dimensional exploded view of a prior art.
Figure 7:
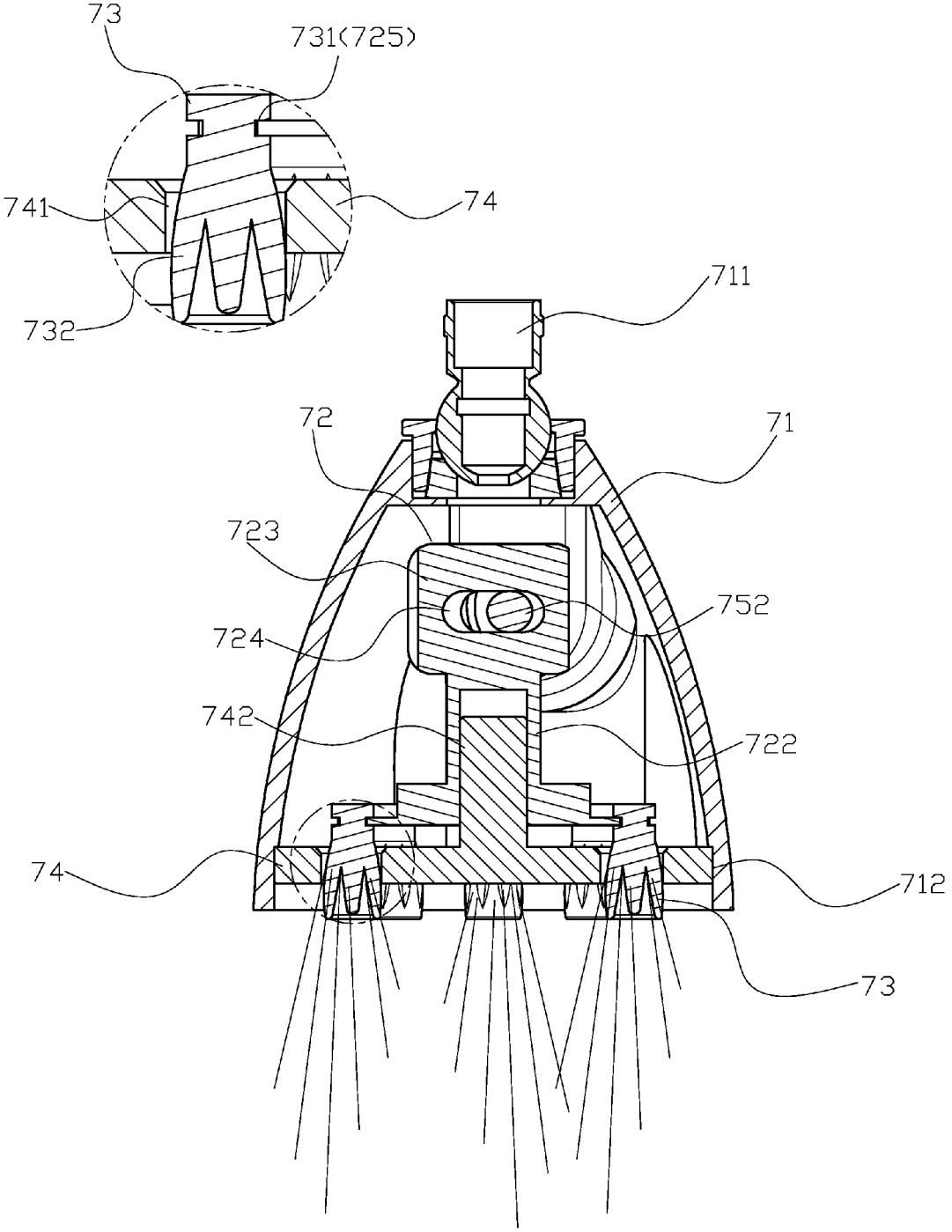
FIG. 7 PRIOR ART
FIG. 7 is a sectional and partial enlarged view of a prior art, wherein the spraying head and through openings that are not in the same central position.
Figure 8:
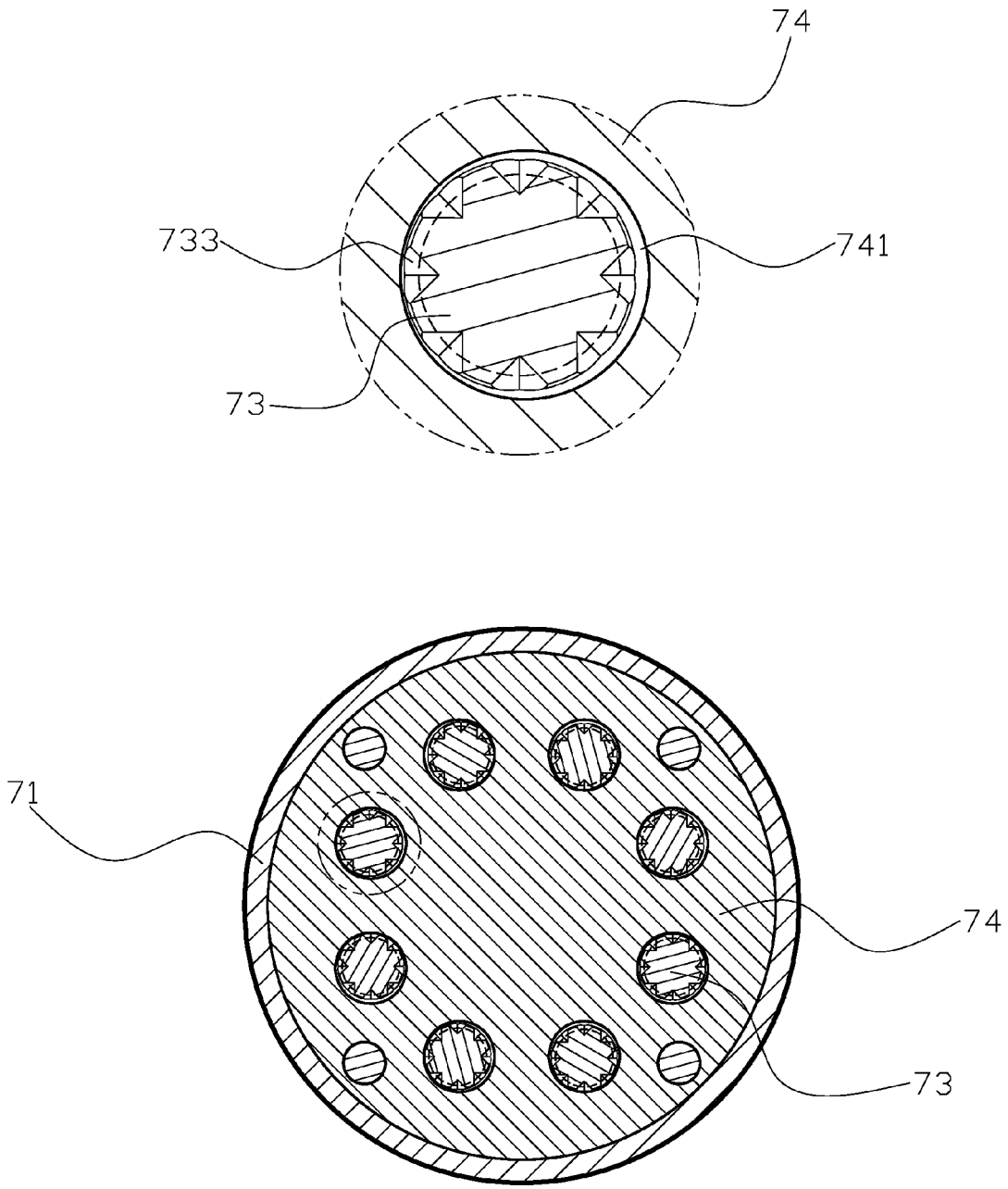
FIG. 8 PRIOR ART
FIG. 8 is a sectional and partial enlarged view from another angle of a prior art, wherein the spraying head and through openings that are not in the same central position.

Referring to FIGS. 1, 4 and 5 for the structure of the present invention, the plastic piece (40) is provided through the through hole (41) for the guiding rod (53) to pass through and evade, and the protruding edge (43) is plugged into the cover through hole (51) to secure the position, so that the plastic piece (40) can be disposed in the receiving space (52) of the metal cover (50). The water spraying head (30) is installed (one by one) at the flat board (21) of the positioning base (20), and disposed into the shell (10) with the positioning base (20) through the opening (12). When the metal cover (50) covers the opening (12), the guiding rod (53) is inserted into the tube (22), and the through opening (42) and through hole (51) are provided for the guiding rod (53) to protrude, the positioning base (20) and the water spraying head (30) can be restricted and engaged. Also, the handle set (60) can be fastened through the nut (63) and installed on the installation hole (13). After the installation, the connecting rod (62) of the handle set (60) will be plugged into the elongated hole (24) of the positioning base (20), so that the movable handle (64) is operated to drive the connecting rod (62) to eccentrically rotate. Thus, the positioning base (20) can drive the water spraying heads (30) to simultaneously move up and down, and the amount and style of the water flows from the water channel (33) can be controlled according to each person's preference by changing relative positions between the water outlet portion (32) and the through openings (42) of the plastic piece (40).

Comparing with the conventional arts, the present invention is advantageous because (i) the quality of injection molding is consistent, the precision of which is not easily affected by external environmental factors. Even though some manufacturing errors in mechanical processing or electroplating may occur during drilling the cover through holes (51) of the metal cover (50), the errors can be corrected by the plastic piece (40), so that the water spraying head (30) and through opening (42) of the plastic piece (40) can remain at the identical central position (see FIGS. 4 and 5), and the water flow can be more even and smoother; and (ii) the receiving space (52) of the metal cover (50) can effectively reduce the amount of copper, and the plastic piece (40) can fill the receiving space (52) for normal usage. So, the structural design can effectively reduce the costs and the shower head is more competitive in the market.

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. A shower head comprising:

a shell, wherein a connecting unit is located at an upper portion of the shell to connect to a water source, and a lower portion thereof has an opening, and an installation hole connecting to an inner space of the opening is disposed at one side of a periphery thereof;

a positioning base, having a flat board, and a tube extending upwards from a center of the flat board, wherein a hanging base that has an elongated hole at a center thereof is sealedly disposed at a top portion of the tube, and a plurality of C-shaped hanging slots are circularly disposed around a periphery of the flat board;

a plurality of water spraying heads, each being engaged with a corresponding one of the plurality of hanging slots via a recessed groove at an upper section of an outer periphery of each water spraying head, so as to evenly and circularly dispose the water spraying heads on the flat board of the positioning base, and a lower portion of each water spraying head is enlarged to form a water outlet portion defining a plurality of olive-shaped water channels along a peripheral surface of the water outlet portion;

a plastic piece formed by injection molding with a through hole formed at a center thereof, and a plurality of through openings circumferentially formed around a periphery of the through hole, and a periphery of each through opening forms a downwardly protruding edge;

a metal cover having a plurality of cover through holes formed therethrough, wherein a recessed receiving space is formed at a top surface of the metal cover, and a guiding rod protrudes upward from a center of the receiving space; and a handle set having a control unit, wherein a connecting rod eccentrically protrudes out from one end of the control unit, and the other end is provided with a nut to lock and engage with a movable handle, wherein the through hole of the plastic piece is provided for the guiding rod to pass therethrough, and each downwardly protruding edge of the plastic piece is plugged into a corresponding one of the metal cover through holes so as to secure the position of the plastic piece relative to the metal cover, so that the plastic piece is disposed in the receiving space of the metal cover, wherein the water spraying heads are installed on the flat board of the positioning base, and subsequently disposed into the shell with the positioning base through the opening, and wherein when the metal cover covers the opening, the guiding rod is inserted into the tube of the positioning base, and the through hole of the plastic piece is provided for the guiding rod to protrude therethrough, such that each of the water spraying heads is restricted and engaged within a corresponding one of the through openings of the plastic piece, and wherein the handle set is fastened through the nut and installed on the installation hole, and the connecting rod of the handle set is plugged into the elongated hole of the positioning base, so that the movable handle is operated to drive the connecting rod to eccentrically rotate, and the positioning base drives the water spraying heads to simultaneously move up and down, and the amount and style of water flows from the water channels are controlled according to each person's preference by changing relative positions between the water outlet portions and the through openings of the plastic piece.

2. The shower head of claim 1, wherein the connecting unit is a universal connector.

3. The shower head of claim 1, wherein the metal cover is made from copper.

4. The shower head of claim 1, wherein the plurality of cover through holes are made by the mechanical process of drilling.

* * * * *